United States Patent [19]

Shiff et al.

[11] Patent Number: 4,542,446

[45] Date of Patent: Sep. 17, 1985

[54] DECORATIVE ORNAMENT HAVING GARLAND AND A LIGHT STRING

[75] Inventors: Max J. Shiff, Germantown; Gene Davis, Memphis, both of Tenn.

[73] Assignee: Decor Noel Corporation, Memphis, Tenn.

[21] Appl. No.: 540,876

[22] Filed: Oct. 11, 1983

[51] Int. Cl.[4] ..... A41G 1/00

[52] U.S. Cl. ..... 362/122; 57/24; 57/203; 362/806; 428/10

[58] Field of Search ..... 57/203, 15, 16, 18, 57/24; 362/806, 122, 123; D11/118, 119, 120; 428/7, 10

[56] References Cited

U.S. PATENT DOCUMENTS

| | | | |
|---|---|---|---|
| 3,118,617 | 1/1964 | Hellrich | 428/18 X |
| 3,253,137 | 5/1966 | Richter, III | 428/10 X |
| 3,677,867 | 7/1972 | Westlund | 428/20 X |
| 3,967,019 | 6/1976 | MaGee | 428/7 |
| 4,262,480 | 4/1981 | Wasserman et al. | 57/16 X |
| 4,346,553 | 8/1982 | Schwartz | 57/16 X |

FOREIGN PATENT DOCUMENTS

| | | | |
|---|---|---|---|
| 986606 | 3/1965 | United Kingdom | 428/10 |

*Primary Examiner*—Henry F. Epstein

*Attorney, Agent, or Firm*—Finnegan, Henderson, Farabow, Garrett and Dunner

[57] ABSTRACT

The present invention provides a decorative ornament that includes a garland, having a center wire and a tinsel strip wound around the center wire. The tinsel strip is divided into a plurality of narrow strands. The invention further includes light string, having an electric wire and a plurality of lights connected together by the electric wire. The light string is wound around the center wire of the garland in a direction opposite to the direction the tinsel strip is wound around the center wire.

22 Claims, 2 Drawing Figures

DECORATIVE ORNAMENT HAVING GARLAND AND A LIGHT STRING

BACKGROUND OF THE INVENTION

The present invention relates generally to decorative ornaments and, more particularly, to an ornament having an artificial garland and a light string for illuminating the decorative ornament.

Consumers have long desired a decorative ornament, especially for the Christmas season, that includes both the garland and the light string in one unit. Although consumers are able to purchase separately various types of artificial garland or tree trim and light strings, they are not able to assemble effectively and safely the garland and the light strings into a single decorative ornament.

If a consumer merely tries to join together the garland and the light string, the result is usually an unaesthetic and structurally unsound product. Since the individually purchased garland and light strings are not compatible, the resulting product tends to unravel shortly after being assembled together. Additionally, an attempt by the consumer to make a permanent connection between the garland and the light string may cause damage to the wire insulation, and create a safety hazard.

SUMMARY OF THE INVENTION

It is accordingly an object of the present invention to provide a decorative ornament comprised of both a garland and a light string.

Another object of the invention is to provide a method and means for attaching a light string to garland.

Another object of the invention is to provide a decorative ornament comprised of both a garland and a light string that is safe to use, aesthetically pleasing, and structurally sound.

To achieve these objects and in accordance with the purpose of the invention, the present invention provides a decorative ornament comprising a garland, having a center wire and a tinsel strip wound around the center wire, the tinsel strip being divided into a plurality of narrow strands; and a light string having an electric wire and a plurality of lights connected together by the electric wire. The light string is wound around the center wire of the garland in a direction opposite to the direction the tinsel strip is wound around the center wire.

The present invention also provides a process for making a decorative ornament comprising the steps of winding a tinsel strip around a center wire to form a garland; and winding a light string, having an electric wire and a plurality of lights connected together by the electric wire, around the center wire of the garland in a direction opposite to the direction the tinsel strip is wound around the center wire.

The present invention obviates the problems associated with previous decorative ornaments and achieves the objects of the invention. The decorative ornament of the present invention offers to the consumer a high degree of safety, convenience, and aesthetic appeal. The ornament is ready to use to decorate a variety of structures, such as a tree, doorway, light pole, stairway, or mantel. The present invention provides a unique combination of garland with a light string to provide an aesthetically pleasing decorative effect.

BRIEF DESCRIPTION OF THE DRAWINGS

The accompanying drawings, which are incorporated in and constitute a part of the specification, illustrate an embodiment of the invention and, together with a description, serve to explain the principles of the invention.

DETAILED DESCRIPTION OF THE PREFERRED EMBODIMENT

Figure 1:
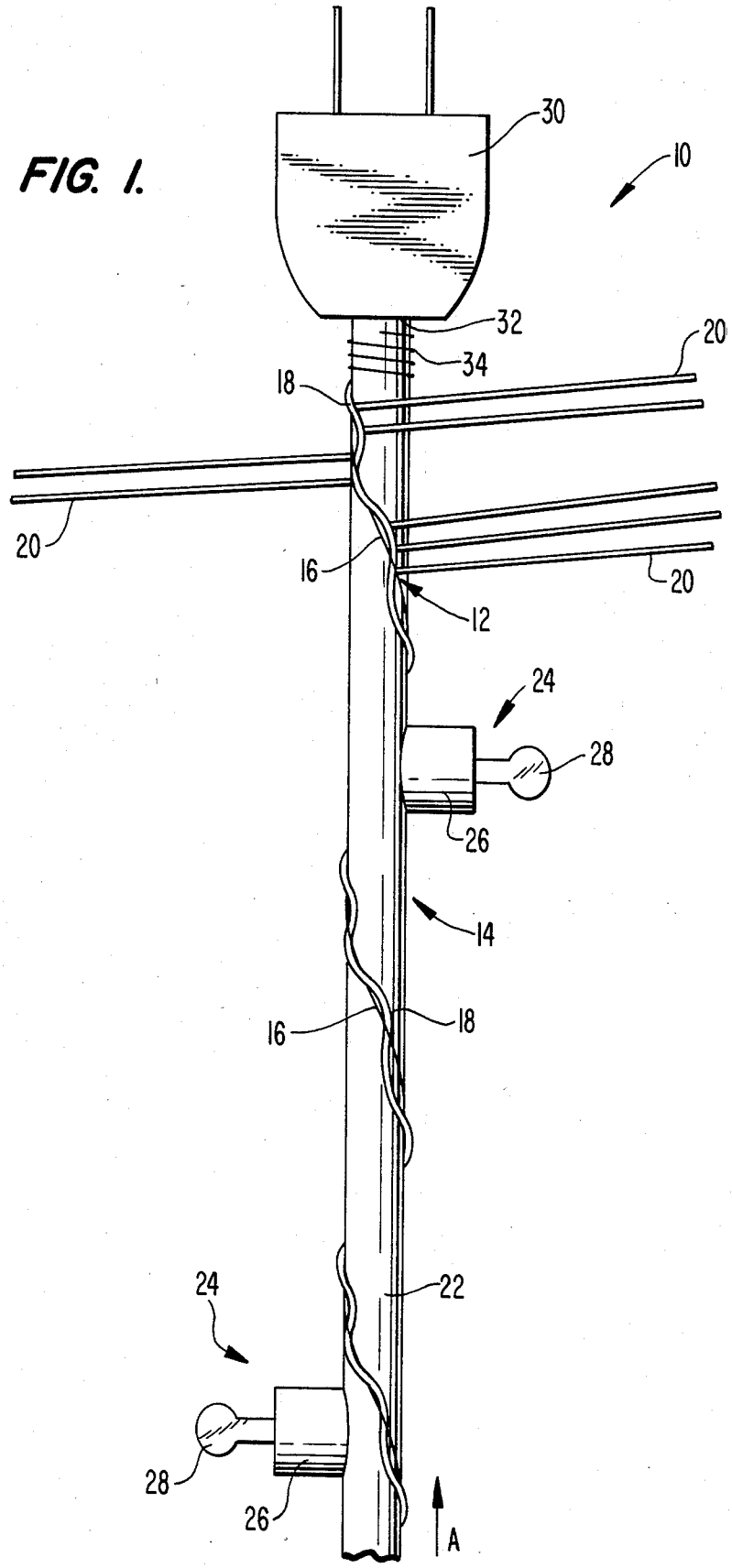
FIG. 1 is an enlarged illustrated view of the decorative ornament of the present invention, in which only a few of the strands of the tinsel strip are drawn to permit a showing of the center wire, garland, and light string.

Reference will now be made in detail to a preferred embodiment of the invention, which is illustrated in the accompanying drawings. The present invention provides a decorative ornament 10 comprising a garland 12 and a light string 14. The garland 12 includes a center wire 16 and a tinsel strip 18. The tinsel strip 18 is divided into a plurality of narrow strands 20. The light string 14 includes an electric wire 22 and a plurality of lights 24 connected together by the electric wire 22. The light string 14 is wound around the center wire 16 of the garland 12 in a direction opposite to the direction the tinsel strip 18 is wound around the center wire 16.

The tinsel strip 18 of the garland 12 is preferably made of a nonflammable and a nonincendiary material, such as a polyvinyl chloride film (hereinafter "PVC"), that allows the garland 12 to be used safely with lights, which may become hot. The PVC film may be either metallized or nonmetallized, depending upon the aesthetic appeal desired. The PVC film, preferably, has a thickness within the range of about 35 $\mu$m to about 120 $\mu$m, since it has been found that a thickness less than 35 $\mu$m causes the PVC film to lack sufficient strength, and a thickness greater than 120 $\mu$m results in the PVC film being too stiff. The PVC film is cut into a plurality of narrow strands 20 so that each strand 20 has a width approximately within the range of 0.9 mm to 1.1 mm. Each strand 20 has a length of approximately 1 to 2 inches.

The center wire 16 of the garland 12, in the preferred embodiment, is made of cotton yarn and zinc wire, which are interwined or wound together. The zinc wire provides the requisite strength to the center wire 16, but it is still flexible enough to allow the garland 12 to be bent or twisted into the desired shape. The yarn cotton also gives the center wire 16 added strength without diminishing its flexibility.

The PVC film can be made into the tinsel strip 18, having a plurality of narrow strands 20, by anyone of many techniques known in the art. Similarly, the tinsel strip 18 or the PVC film can be wound around the center wire 16 by a conventional garland winding machine or apparatus. Preferably, in accordance with well-known garland winding operations, the tinsel strip 18 and the center wire 16 are fed independently through a machine, having a center throat, into a large centrifuge that winds the tinsel strip 18 around the center wire 16 as the centrifuge spins.

In the preferred embodiment, the tinsel strip 18 is wound around the center wire 16 in a clockwise direction. To achieve this clockwise wrapping, the centrifuge machine noted above would be set to spin in a clockwise direction as viewed from point A in FIG. 2. It has been found that a clockwise wrap presents a more permanent twist between the tinsel strip 18 and the center wire 16, than with a counter clockwise wrap. The centrifuge rotation velocity and the amount the tinsel strip 18 which is twisted depend upon the desired cosmetic appearance and construction of the garland 12.

The light string 14 is preferably an electric decorative lighting string, such as a miniature light set. The light string 14 has about 12 to 20 lights 24 spaced along the electric wire 22. Each light 24 has a socket 26 into which a light bulb 28 is inserted. Typically, the light string 14 is constructed to be used with a 115–125 volts of electricity. An electric plug 30 is connected to each end 32 of the light string 14.

The electric wire 22 of the light string 14 is 5 to 6% longer than the center wire 16 of the garland 12, the latter being measured in the wound condition within the finished garland 12. The electric wire 22 needs to be longer than the center wire 16 by this factor to account for the amount of electric wire 22 needed to wind around the center wire 16. For example, if the center wire 16 is 9 feet long, then the electric wire 22 is about 9.5 feet long. When the 9.5 foot long electric wire 22 is wound around the 9 foot long center wire 16, the resulting decorative ornament 10 is 9 feet in length. Similarly, if the center wire 16 is 18 feet long then, within the scope of the invention, the electric wire 22 is 19 feet long.

The light string 14 is wound around the center wire 16 of the garland 12 in a direction opposite to the direction the tinsel strip 18 is wound around the center wire 16. Consequently, if the tinsel strip 18 is wound around the center wire 16 in a clockwise direction as viewed from point A in FIG. 2 then the light string 14 is wound around the center wire 16 of the garland 12 in a counterclockwise direction as viewed from point A in FIG. 2. By winding the light string 14 around the center wire 16 in a direction opposite to the direction that the tinsel strip 18 is wound around the center wire 16, the tinsel strip 18 does not unravel from the center wire 16.

In the preferred embodiment, the light string 14 is wound around the center wire 16 of the garland 12 between 83 and 101 times for each nine (9) feet length of center wire 16. The number of times the light string 14 is wound around the center wire 16 of the garland 12 increases or decreases by a factor of 3, as the length of the center wire 16 increases or decreases by a factor of 2.

For example, if the length of the center wire 16 is 18 feet long, the light string 14 is wound around the center wire 16 between 249 and 303 times. If, instead, the center wire is 4.5 feet long, then the light string 14 is wound around the center wire 16 between 27 and 34 times. Other lengths and number of twists can be used within the scope of the invention.

After the light string 14 is wound around the center wire 16, each end 34 of the garland 12 is looped around the electric plug 30 at the end 32 of the electric wire 22 adjacent to the end of the garland 12. A fastening means secures each end of the electric wire 22 to the end of the center wire 16. As embodied herein, the fastening means includes staples, fasteners, and adhesives. Fastening means should be selected so as not to damage the electric wire 22.

The present invention also provides a process for making the decorative ornament 10 comprising the steps of winding the tinsel strip 18 around the center wire 16 to form a garland 12, and, then, winding the light string 14 around the center wire 16 of the garland 12 in a direction opposite to the direction the tinsel strip 18 is wound around the center wire 16. As noted above, the tinsel strip 18 is preferably wound around the center wire 16 in a clockwise direction, (as viewed from point A in FIG. 2) and, consequently, the light string 14 is wound around the center wire in a counterclockwise direction, as viewed from point A in FIG. 2.

Figure 2:
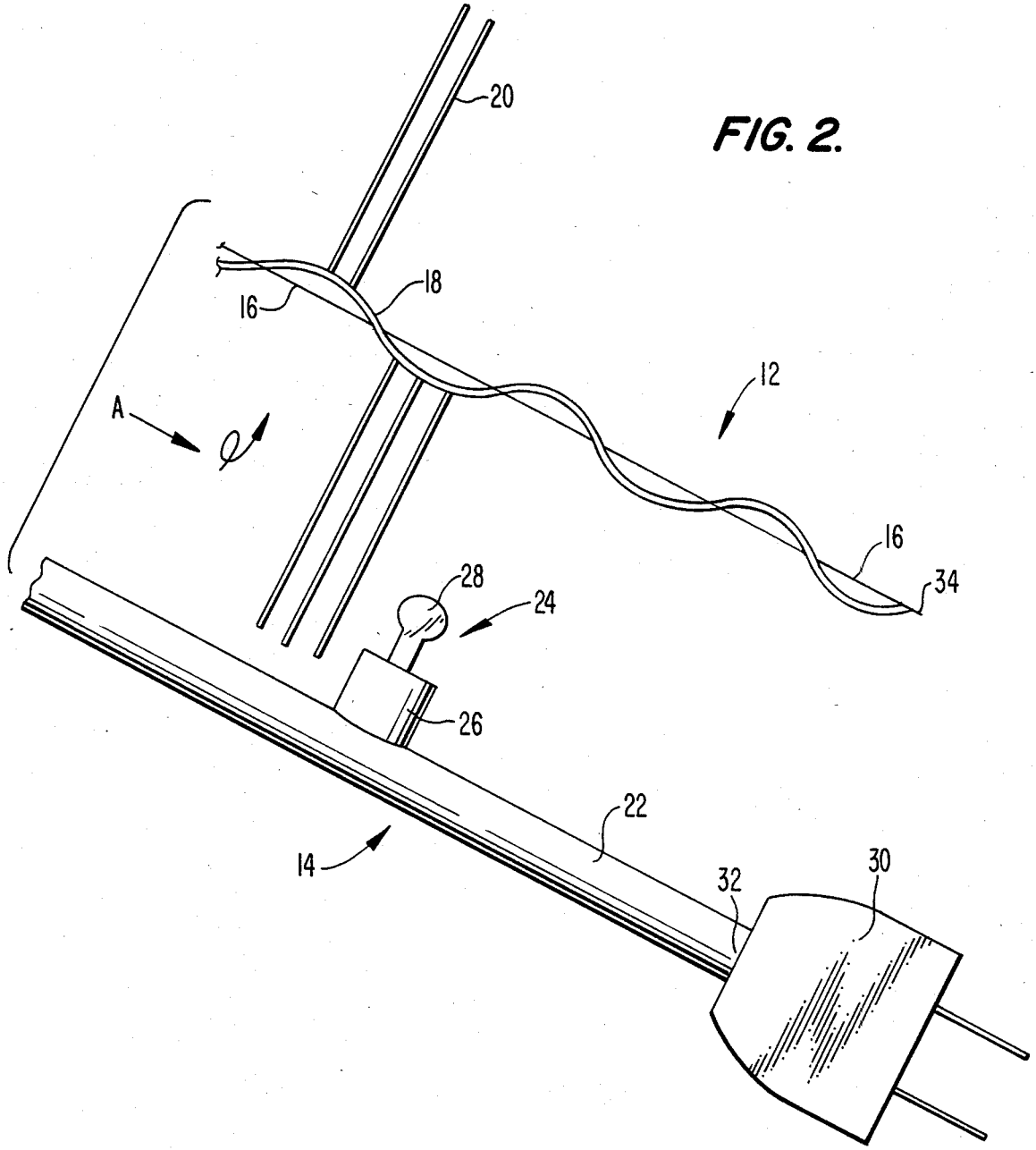
FIG. 2 illustrates a process for winding the light string around the center wire of the garland to make the decorative ornament.

The step of winding the light string 14 around the center wire 16 can be accomplished either manually or mechanically. In the manual process, the garland 12 and the light string 14 are suspended parallel to each other in a horizontal incline, as illustrated in FIG. 2. The lower ends of the garland 12 and the light string 14 are held stationary, and the two top ends are wound together simultaneously in a counterclockwise direction for a predetermined number of revolutions, as indicated above. The ends 34 of the garland 12 are then looped around the base of the electric plugs 30 of the light set 14 and secured with fastening means, as described above.

The mechanical process of winding the light string 14 around the center wire 16 is an adaptation of the manual process to automatic winding equipment. The advantages of the mechanical process are greater speed and better consistency of product.

It is preferred that during the winding of the light string 14 around the center wire 16 of the garland 12, the light string 14 and the center wire 16 are suspended parallel at a horizontal incline within the range of 9° to 11°, for a 9 foot length of center wire 16. This angle of incline increases or decreases by a factor of 3, as the length of the wire increases or decreases by a factor of 2.

It will be apparent to those skilled in the art that various other modifications and variations could be made in the structure and process of the invention without parting from the scope and content of the invention.

What is claimed is:

1. A decorative ornament comprising:

(a) a garland having a center wire and a tinsel strip wound around the center wire, the tinsel strip being divided into a plurality of narrow strands; and (b) a light string having an electric wire and a plurality of lights connected together by the electric wire, the light string being wound around the center wire of the garland in a direction opposite to the direction the tinsel strip is wound around the center wire.

2. The decorative ornament of claim 1, wherein the tinsel strip is wound around the center wire of the garland in a clockwise direction.

3. The decorative ornament of claim 1, wherein the light string is wound around the center wire of the garland in a counterclockwise direction.

4. The decorative ornament of claim 1, wherein the light string is wound around the center wire of the garland between 83 and 101 times for each 9 feet length of center wire.

5. The decorative ornament of claim 4, wherein the number of times the light string is wound around the wire of the garland increases or decreases by a factor of 3 as the length of the center wire increases or decreases by a factor of 2.

6. The decorative ornament of claim 1, wherein the electric wire is 5 to 6% longer than the center wire.

7. The decorative ornament of claim 1, further comprising an electric plug at each end of the electric wire.

8. The decorative ornament of claim 7, wherein each end of the garland is looped around one of the electric plugs.

9. The decorative ornament of claim 1, further comprising a fastening means for securing each end of the electric wire to an end of the center wire.

10. The decorative ornament of claim 1, wherein the tinsel strip is a PVC film.

11. The decorative ornament of claim 10, wherein the thickness of the PVC film is within the range of 35 $\mu$m to 120 $\mu$m.

12. The decorative ornament of claim 10, wherein the width of each strand of the tinsel strip is within the range of 0.9 mm to 1.1 mm.

13. The decorative ornament of claim 10, wherein the length of each strand of the tinsel strip is 1 to 2 inches.

14. The decorative ornament of claim 1, wherein the center wire is composed of cotton yarn and zinc wire.

15. A process for making a decorative ornament comprising the steps of:

(a) winding a tinsel strip around a center wire to form a garland; and (b) winding a light string, having an electric wire and a plurality of lights connected together by the electric wire, around the center wire of the garland in a direction opposite to the direction the tinsel strip is wound around the center wire.

16. The process for making a decorative ornament of claim 15, wherein the tinsel strip is wound around the center wire in a clockwise direction.

17. The process for making a decorative ornament of claim 15, wherein the light string is wound around the center wire in a counterclockwise direction.

18. The process for making a decorative ornament of claim 15, wherein the light string is wound around the center wire of the garland between 83 and 101 times for each 9 foot length of center wire.

19. The process for making a decorative ornament of claim 15, wherein the number of times the light string is wound around the wire of the garland increases or decreases by a factor of 3 as the length of the center wire increases or decreases by a factor of 2.

20. The process for making a decorative ornament of claim 15, wherein during the winding of the light string around the center wire of the garland, the light string and center wire are suspended parallel at a horizontal incline within the range of 9° to 11°, for a 9 feet length of center wire.

21. The process for making a decorative ornament of claim 20, wherein the angle of incline increases or decreases by a factor of 3 as the length of the wire increases or decreases by a factor of 2.

22. The process for making a decorative ornament of claim 15, further comprising the step of securing each end of the electric wire to an end of the center wire.

* * * * *